US009661920B2

(12) United States Patent
Ahart

(10) Patent No.: US 9,661,920 B2
(45) Date of Patent: May 30, 2017

(54) MODULAR STORAGE SYSTEM HAVING SELF LOCKING COMPONENTS THAT ARE RECONFIGURABLE WITHOUT THE NEED FOR TOOLS AND/OR FASTENERS

(71) Applicant: Gregory James Ahart, Boyertown, PA (US)

(72) Inventor: Gregory James Ahart, Boyertown, PA (US)

( * ) Notice: Subject to any disclaimer, the term of this patent is extended or adjusted under 35 U.S.C. 154(b) by 0 days.

(21) Appl. No.: 15/017,184

(22) Filed: Feb. 5, 2016

(65) Prior Publication Data

US 2016/0235195 A1 Aug. 18, 2016

Related U.S. Application Data

(63) Continuation-in-part of application No. 14/466,933, filed on Aug. 22, 2014, now Pat. No. 9,282,816.

(Continued)

(51) Int. Cl.

| | |
|---|---|
| ***A47F 5/08*** | (2006.01) |
| ***A47B 47/00*** | (2006.01) |
| ***A47B 57/08*** | (2006.01) |
| ***A47B 96/06*** | (2006.01) |
| ***A47B 96/02*** | (2006.01) |
| ***A47B 88/417*** | (2017.01) |
| *A47F 5/00* | (2006.01) |
| *A47B 83/04* | (2006.01) |

(52) U.S. Cl.

CPC ..... *A47B 47/0091* (2013.01); *A47B 57/08* (2013.01); *A47B 88/417* (2017.01); *A47B 96/024* (2013.01); *A47B 96/06* (2013.01); *A47B 83/045* (2013.01); *A47B 96/067* (2013.01); *A47F 5/00* (2013.01); *A47F 5/08* (2013.01)

(58) Field of Classification Search

CPC . A47B 47/0091; A47B 47/0041; A47B 85/00; A47B 96/06; A47B 96/1441; A47B 83/045; A47B 96/067; A47B 57/08; A47B 96/024; A47B 88/417; A47F 5/00; A47F 5/08

USPC ..... 211/189, 175, 85.3, 118, 90.01, 90.02, 211/94.01, 134, 186, 187; 108/59, 108/158.12, 180; 312/245, 257.1, 108

See application file for complete search history.

(56) References Cited

U.S. PATENT DOCUMENTS 2,056,544 A * 10/1936 Vanderveld ..... A47B 61/003 211/123

2,366,676 A * 1/1945 Rosenthal ..... A47B 47/042 108/180

(Continued)

*Primary Examiner* — Joshua J Michener
*Assistant Examiner* — Devin Barnett
(74) *Attorney, Agent, or Firm* — Douglas J. Ryder; Ryder, Lu, Mazzeo & Konieczny LLC

(57) ABSTRACT

A modular storage system capable of mounting storage fixtures such as shelves, drawers, rods, desks, hampers, trash cans and the like in various configurations without the use of tools and fastener hardware. The system includes vertical side panels capable of being mounted to a horizontal support rail, which is attached to a wall, in various configurations allowing the system to be mounted and rearranged against the wall without the use of tools and hardware. The vertical side panels include a plurality of support cleats that mate with the storage fixtures and provide for self-locking of the storage fixtures in the system so that they can be mounted and rearranged without the use of tools and hardware.

20 Claims, 9 Drawing Sheets

Related U.S. Application Data

(60) Provisional application No. 61/869,607, filed on Aug. 23, 2013.

(56) References Cited

U.S. PATENT DOCUMENTS 2,580,334 A * 12/1951 Vanderveld ..... A47B 47/00 211/135
2,710,241 A * 6/1955 Lieberman ..... A47B 47/05 108/106
2,727,800 A * 12/1955 Snider ..... A47B 61/00 292/162
2,980,260 A * 4/1961 Richer ..... B65D 85/185 206/279
3,021,958 A * 2/1962 Winkler ..... B65D 85/185 211/124
3,087,771 A 4/1963 Pari
3,497,279 A 2/1970 Chovanec
3,633,760 A * 1/1972 Vosbikian ..... B65D 85/185 206/279
3,698,565 A * 10/1972 Weber ..... A47F 5/0846 211/126.15
3,744,437 A * 7/1973 Tesar ..... A47B 43/00 108/158.12
3,814,034 A * 6/1974 Seiz ..... A62C 35/58 108/187
4,122,762 A * 10/1978 Williams ..... F24F 13/072 248/343
4,206,955 A 6/1980 Cooper
4,236,460 A * 12/1980 Poupko ..... A47B 85/00 108/162
4,336,673 A * 6/1982 Duchesne ..... G09F 13/04 211/189
4,396,124 A * 8/1983 Feder ..... B65D 85/185 206/290
4,666,117 A * 5/1987 Taft ..... A47B 96/063 108/108
4,728,158 A * 3/1988 D'Elia ..... A47B 57/06 211/184
4,928,833 A 5/1990 Huizenga
5,135,194 A 8/1992 Laughnon
5,149,166 A * 9/1992 Wille ..... B60R 13/04 293/128
5,191,986 A * 3/1993 Huizenga ..... A47B 61/00 211/189
5,205,630 A * 4/1993 Welch ..... A47B 47/021 108/107
5,222,611 A 6/1993 Wood
5,257,701 A * 11/1993 Edelson ..... A47B 3/10 108/116
5,337,905 A * 8/1994 Gast ..... A47B 61/00 211/105.3
5,495,954 A 3/1996 Schmit
D368,814 S * 4/1996 Riback ..... D6/683
5,582,306 A * 12/1996 Balter ..... A47B 61/00 211/105.1
5,671,990 A * 9/1997 Teasdale ..... A47B 43/006 108/149
5,775,046 A * 7/1998 Fanger ..... A47B 81/06 108/157.16
5,819,958 A 10/1998 Dement
6,019,445 A * 2/2000 Gades ..... D06F 95/002 312/245
6,557,711 B2 * 5/2003 Grueneberg ..... A47F 5/0068 211/119.003
6,568,545 B2 5/2003 Feder
6,681,941 B1 * 1/2004 Johnson ..... A47B 57/00 211/105.1
6,758,352 B2 * 7/2004 Gervasi ..... A47F 5/0018 108/134
6,877,826 B2 * 4/2005 Wood ..... A47B 45/00 108/110
7,384,107 B2 * 6/2008 Humberto ..... A47B 57/10 108/193
7,497,533 B2 * 3/2009 Remmers ..... A47B 57/42 108/108
7,805,904 B2 * 10/2010 Clark ..... A47F 5/0892 248/317
8,025,164 B2 9/2011 Humberto
8,430,254 B2 * 4/2013 Kunis ..... A47B 61/00 211/189
8,444,235 B2 5/2013 Gmerek
8,448,794 B1 * 5/2013 Wang ..... A47B 43/04 206/286
8,517,189 B2 * 8/2013 Donohoe ..... A47B 47/042 211/87.01
8,579,127 B2 * 11/2013 Dyck ..... A47B 57/485 211/103
8,684,195 B1 4/2014 Caruso
8,752,718 B2 * 6/2014 Stukenberg ..... A47G 25/0664 211/87.01
2003/0196976 A1 * 10/2003 Gervasi ..... A47F 5/0018 211/153
2006/0169659 A1 8/2006 Robinson
2006/0243688 A1 11/2006 Gilcrest
2007/0108147 A1 * 5/2007 Chen ..... A47B 47/00 211/187
2008/0237162 A1 * 10/2008 Lynch ..... A47B 47/00 211/90.01
2010/0116762 A1 * 5/2010 Piersant ..... A47B 95/008 211/90.01
2011/0025180 A1 * 2/2011 Ilich ..... A47B 95/008 312/237
2011/0025181 A1 * 2/2011 Vinke ..... A47B 57/20 312/257.1
2011/0074256 A1 * 3/2011 Boice ..... A47B 81/00 312/213
2011/0266237 A1 * 11/2011 Artigues ..... A47B 61/003 211/90.02
2013/0056434 A1 3/2013 Artigues
2015/0053635 A1 * 2/2015 Ahart ..... A47B 47/0091 211/188

* cited by examiner

MODULAR STORAGE SYSTEM HAVING SELF LOCKING COMPONENTS THAT ARE RECONFIGURABLE WITHOUT THE NEED FOR TOOLS AND/OR FASTENERS

PRIORITY

This application is a continuation in part (CIP) and claims the benefit under 35 USC §120 of application Ser. No. 14/466,933, filed on Aug. 22, 2014, and entitled "Modular Storage System having Self Locking Components that are Reconfigured without the need for Tools and/or Fasteners". Application Ser. No. 14/466,933 claims the priority under 35 USC §119 of Provisional Application 61/896,607, filed Aug. 23, 2013, and entitled "Novel Modular Storage System and Devices With Attachments Thereto". Gregory J. Ahart is the inventor for this application and both application Ser. Nos. 14/466,933 and 61/896,607. Application Ser. Nos. 14/466,933 and 61/896,607 are herein incorporated by reference in their entirety.

BACKGROUND

There are many types of storage devices available to facilitate the organization of clothes and other objects. A recent trend in storage and organization involves the use of prefabricated modular units that are assembled by the end user. These units include storage fixtures such as shelves and drawers that fit into a frame and may be free standing or mounted on walls. Some units allow the user to assemble the shelves and drawers according to user preference, while other units are made to be assembled in one way only therefor limiting its design and usefulness. Some units require tools and/or mounting hardware to install the systems.

Therefore, a need exists for a modular storage device that is capable of mounting many different types of storage fixtures in many different configurations. It is also a further need for the modular storage device to not require the use of tools when assembling and rearranging the storage fixtures. Finally, there is a need for the storage system to assemble and mount to walls without the use of complex brackets and hardware saving the user time when installing a new system.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION

The terminology used herein is for the purpose of describing particular embodiments only and is not intended to be limiting of the invention. Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

New modular storage devices and systems are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

Figure 1:
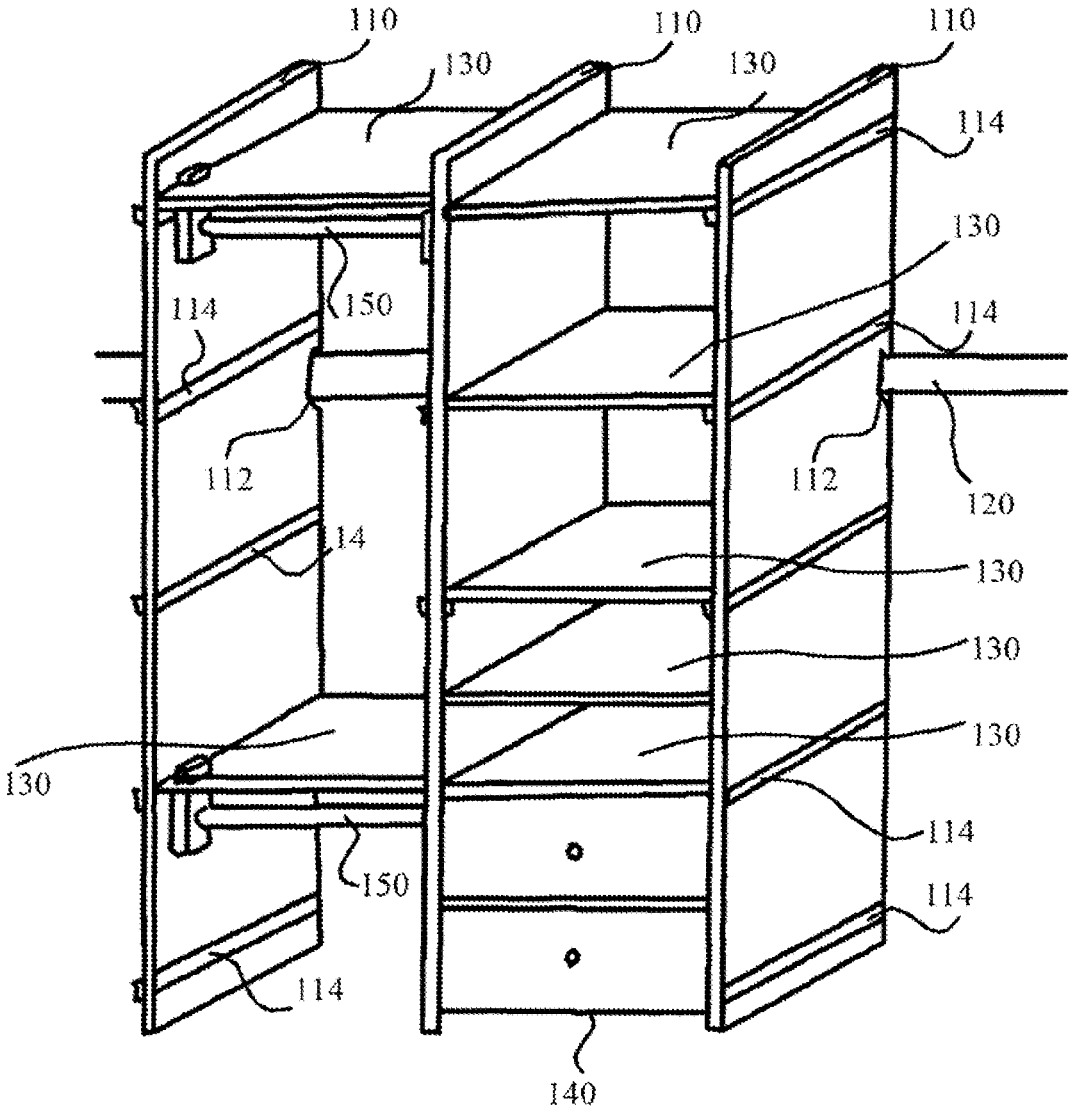
FIG. 1 illustrates a perspective view of an example modular storage system, according to one embodiment.

FIG. 1 illustrates a perspective view of an example modular storage system. The example modular storage system includes a plurality of side panels 110, a support rail 120, and one or more horizontal surfaces 130. The support rail 120 is mounted to a wall or vertical surface with one or more fastener means (e.g., screws, nails, bolts). The support rail 120 is the only part of the system that requires tools (e.g., drill, screw driver, level) and hardware (fastener means) to install. The side panels 110 may include a notch 112 formed in a back edge thereof that is utilized to hang the side panels 110 on the support rail 120. The side panels 110 hang vertically from the support rail 120. The side panels 110 are not separately attached to the wall or vertical surface. Accordingly, the side panels 110 can be mounted, arranged and removed from the system without the need for tools or fasteners.

The side panels 110 include a plurality of cleats 114 running horizontally (illustrated as running from a front edge to a back edge). According to one embodiment, the spacing and orientation of the cleats 114 is the same on each of the side panels 110 so that the cleats 114 on adjacent side panels 110 will be aligned. The one or more horizontal surfaces 130 may include grooves formed therein that are in alignment with the cleats 114. The one or more horizontal surfaces 130 may be inserted between the adjacent side panels 110. The one or more horizontal surfaces 130 may be secured by the grooves engaging the cleats 114. The use of the cleats 114 and the aligned groves provides for self-locking of the horizontal surfaces 130 within the system (not require any tools or fasteners). Furthermore, it provides for easy removal, rearranging or addition of the horizontal surfaces 130 with the system without the need for tools or fasteners.

The one or more horizontal surfaces 130 provide lateral support for the side panels 110 (keep the side panels appropriately spaced from one another). As illustrated, the horizontal surfaces 130 are flat surfaces that may be utilized, for example, as shelves for storage or a desk for performing tasks. If a horizontal surface 130 is to be utilized for certain uses (e.g., desk) it may be thicker, longer and/or wider to provide additional support and/or provide additional room between the side panels 110.

According to one embodiment, the cleats 114 may be spaced apart by defined dimensions on the side panels 110. For example, the cleats 114 may be spaced apart based on a standard shelf height. According to one embodiment, the cleats 114 may be spaced approximately fourteen inches apart though the spacing is in no manner intended to be limited thereby. The horizontal surfaces 130 may be placed on some or all of the cleats 114.

The horizontal surfaces 130 may be placed between the adjacent side panels 110 at various locations based on the location of the cleats 114. The location of the horizontal surfaces 130 between sets of adjacent side panels 110 does not need to be the same. As illustrated, there are only two horizontal surfaces 130 between the left and center side panels 110 and five horizontal surfaces 130 between the center and right side panels 110. As illustrated, it appears that the fourth horizontal surface 130 from the top on the right is located between cleats 114. It will be discussed in more detail later how this may be done.

In addition to providing horizontal surfaces 130 between the side panels 110, the system 100 may also include other storage components, for example, drawers 140 and rods 150. In order to install these other components, support components (not separately labeled in FIG. 1) may be utilized in the system. The support components may be utilized without the need for tools and/or fasteners as will be discussed in more detail later. As illustrated, the left side includes two rods 150 and the right side includes one large drawer or two small drawers 140.

The system is configured to accept a plurality of storage components (e.g., shelves, desks, drawers, rods) by, for example, securing them to the cleats 114. The storage components may include channels having complimentary dimensions to the cleats 114 so that engagement is sufficient to secure the storage fixtures in the system without the need for tools, fasteners or hardware. The engagement is made more secure by the placement of clothes, items, and weight on the storage fixtures. This engagement is easily disengaged by removing the items from the storage fixtures and subsequently lifting the storage fixtures off of the cleats 114. This enables disassembly and rearrangement of the storage fixtures without the need for tools.

Figure 2A:
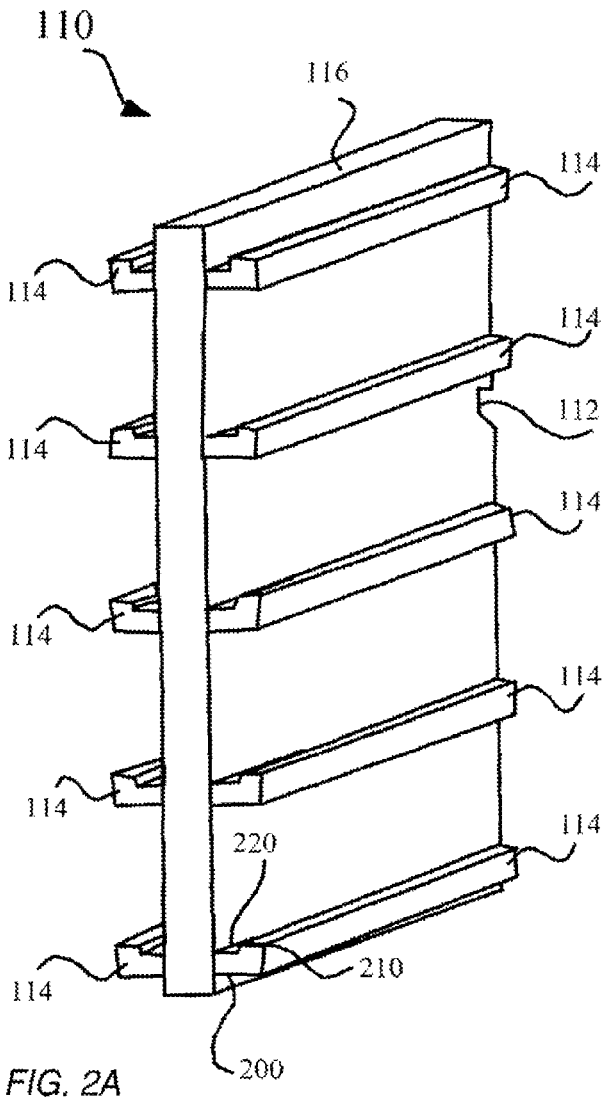
FIGS. 2A-B illustrate different perspective views of example side panels used in a modular storage system, according to one embodiment.
Figure 2B:
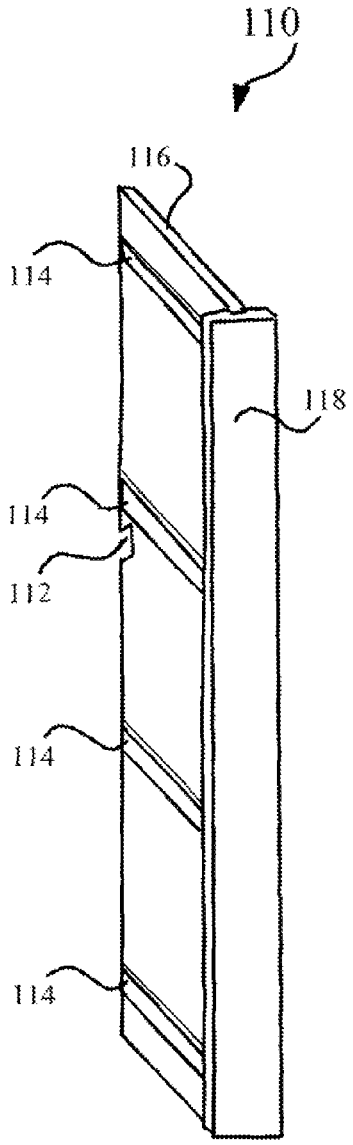

FIGS. 2A-B illustrate different perspective views of example side panels 110 used in a modular storage system. The side panels 110 include a main body 116 having a plurality of cleats 114 extending therefrom and a notch 112 formed in a back edge. As noted above with respect to FIG. 1, the notch 112 is to hang the side panel 110 on a support rail 120. As illustrated, the notch 112 is just below a second cleat 114 but is in no way intended to be limited thereto.

While not illustrated, the support rail 120 may include an upper surface that acts as a load bearing surface. The upper surface may include a portion that is angled downward towards the wall it is mounted to in order to assist at locking the side panel 110 in place. The angles portion may also act as a load bearing surface. While not illustrated clearly, the notch 112 may include an angled portion in an upper edge in alignment with the angled portion in the support rail 120. The notch 112 may also include an angled portion on a lower edge that provides clearance to enable the side panel 110 to be mounted on the support rail. Both the upper load bearing surface and the angled load bearing surface may be continuous along the entire length of the support rail 120 and are configured to hold the side panel 110 securely against the support rail 120 and vertical surface (e.g. a wall) it is mounted to. The side panels 110 are able to be easily mounted and reconfigured at various locations on a wall without the use of mounting tools or hardware.

As illustrated in FIG. 2A, the cleats 114 extend from both sides of the main body 116 in alignment with each other. This enables any side panel 110 to be used in any location and/or orientation in the system. The cleats 114 may be "L" shaped with a first portion 200 extending substantially perpendicular to the main body 116 and a second portion 210 extending substantially perpendicular to the first portion 200 and substantially parallel to the main body 116. A groove 220 is formed between the first and second portions 200, 210 and the main body 116. It should be noted that for ease of illustration the parts of the cleat 114 are only labeled for a single cleat 114. The cleats 114 may be secured to the main body 116 using a securing means (e.g., screws, nails, glue). According to one embodiment, the main body 116 may have a groove formed therein and the first portion 200 of the cleat 114 may be secured within the grove. Such an arrangement may provide for easier alignment and additional structural integrity.

As illustrated in FIG. 2B, the side panel 110 may include a face plate (vertical trim) 118. The face plate 118 may extend horizontally past a front edge of the main body 116. The use of the face plate secures the horizontal surfaces 130 within the system (prevents the horizontal surfaces from being able to be pulled or slide straight out). The face plate 118 may also hide the cleats 114 so as to provide an aesthetically pleasing look.

Figure 3A:
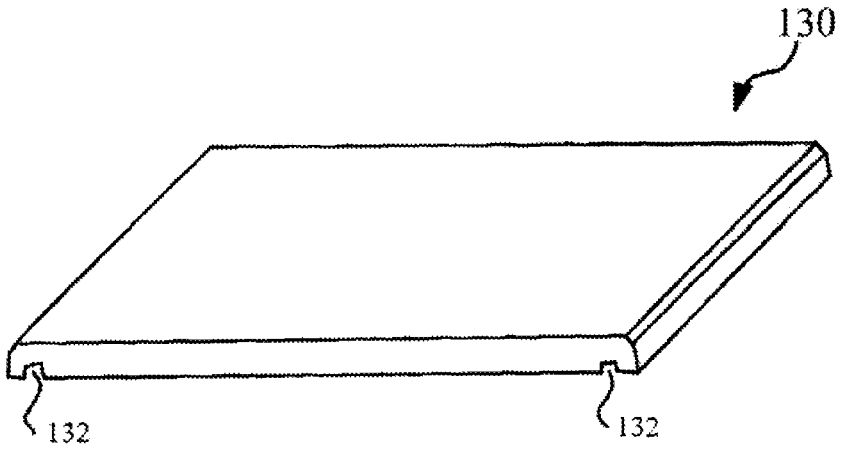
FIGS. 3A-C illustrate upper perspective, lower perspective and front views of example horizontal surfaces used in a modular storage system, according to one embodiment.
Figure 3B:
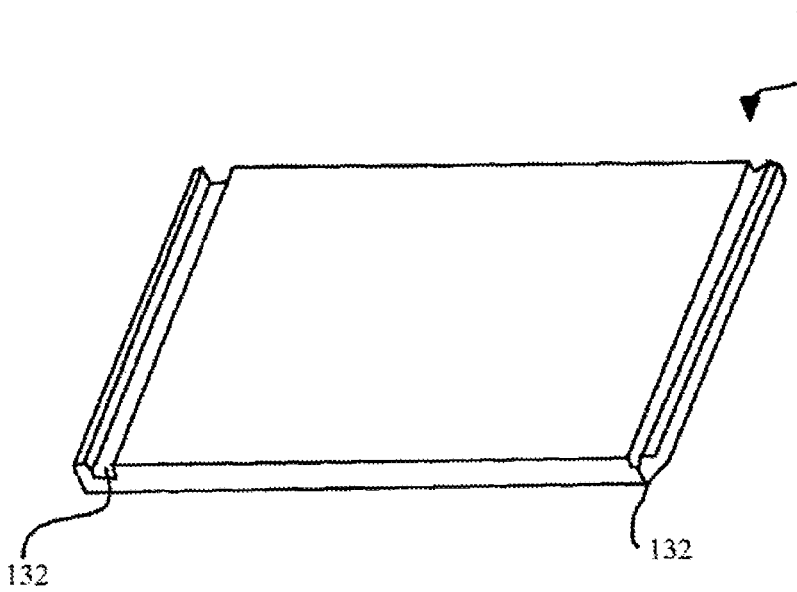
Figure 3C:
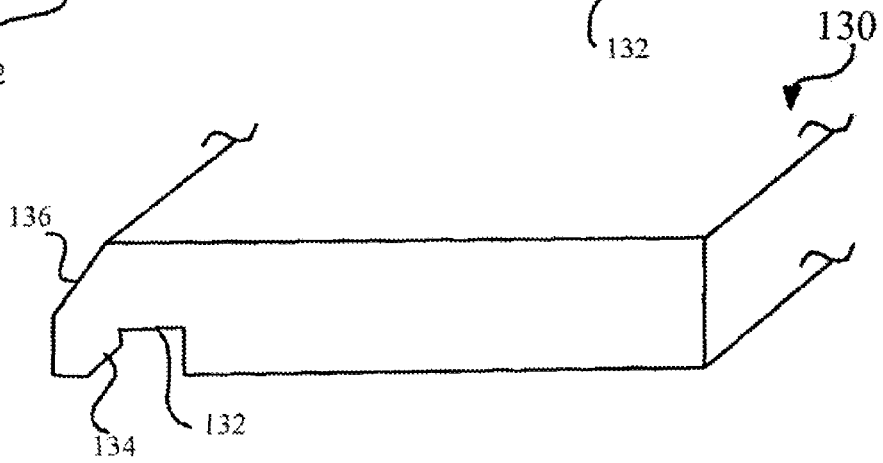

FIGS. 3A-C illustrate upper perspective, lower perspective and front views of example horizontal surfaces 130 used in a modular storage system. The horizontal surface 130 includes channels 132 formed along the edges thereof. The channels 132 are formed so as to receive the second portion 210 of the cleats 114. As illustrated in FIG. 3C, the horizontal surface 130 may include tapered edges 136 to provide additional clearance to enable easier installation and removal. The tapered edges 136 enable the horizontal surface 130 to be installed or removed at different angles. In addition, the horizontal surface 130 may include a tapered wall 134 on the channel 132. The tapered wall 134 also provides additional clearance to enable the horizontal surface 130 to be installed or removed at different angles. The angle associated with the tapered edges 136 and the tapered walls 134 may vary based on different parameters, such as length and thickness of the horizontal surface 130, distance between cleats 114, thickness of second portion 210 of cleats 114 and corresponding thickness of grove 132.

Although the cleats 114 are illustrated as being "L" shaped and the channels are configured to be received thereby, other male/female and cleat/channel designs may be used without departing from the scope of the invention.

The use of the cleats 114 that traverse substantially an entire depth of the side panels 110 enables a load of a horizontal surface 130 and anything placed on top of that to be evenly distributed over the length of the cleats 114 and the side panels 110. The distribution of the load may also be transferred to the wall so as to be evenly distributed thereover. The load distribution enables the horizontal surface 130 and the system to support more weight than a standard system using, for example, four pins to provide support therefore.

Figure 4A:
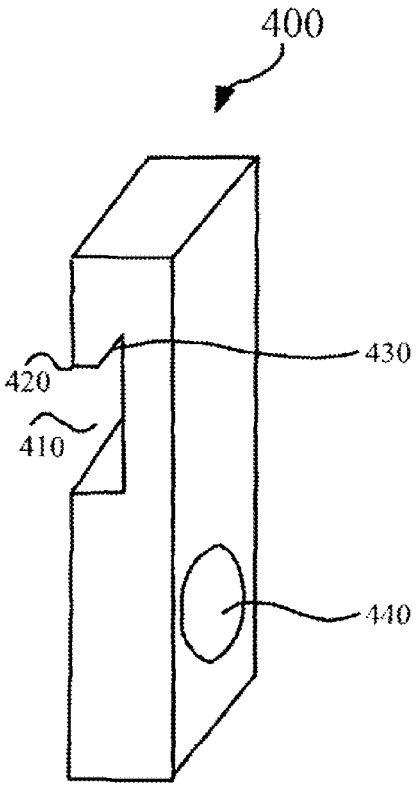
FIGS. 4A-B illustrate side and front views of an example rod bracket that may be used in a modular storage system, according to one embodiment.
Figure 4B:
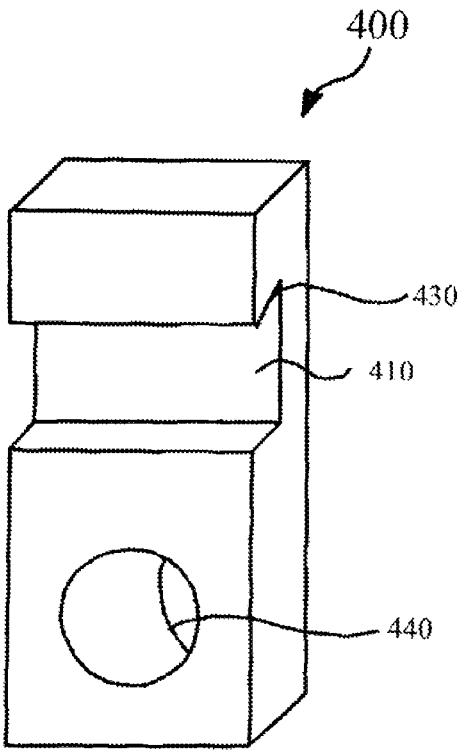

FIGS. 4A-B illustrate side and front views of an example rod bracket 400 that may be used in a modular storage system. The rod bracket 400 is designed to hang from a cleat 114 and provide a receptacle below the cleat 114 for receiving a rod 150 that may be used, for example, to hang clothes therefrom. The rod bracket 400 includes a channel 410 formed therein that is to mount on the cleat 114. The channel 410 may include an upper arm 420 to extend into an outer edge of the channel 410 that is to fit within the groove 220 formed between the first and second portions 200, 210 of the cleat 114 and the main body 116 of the side panel 110. According to one embodiment, the upper arm 420 may include a tapered wall 430. The rod bracket 400 further includes a hole 440 formed therein for receiving and securing a rod 150. The placement of the rod 150 between adjacent rod brackets 400 will secure the rod bracket 400 against the side panels 110 (the rod brackets are self-locking within the system with the need for tools or fasteners).

In order to provide additional support, a horizontal surface 130 may be placed on the same cleats 114 that the rod bracket 400 is mounted on. The horizontal surface 130 would ensure that the rod bracket 400 stayed in place and would provide lateral support to the side panels 110 at this point.

Figure 5:
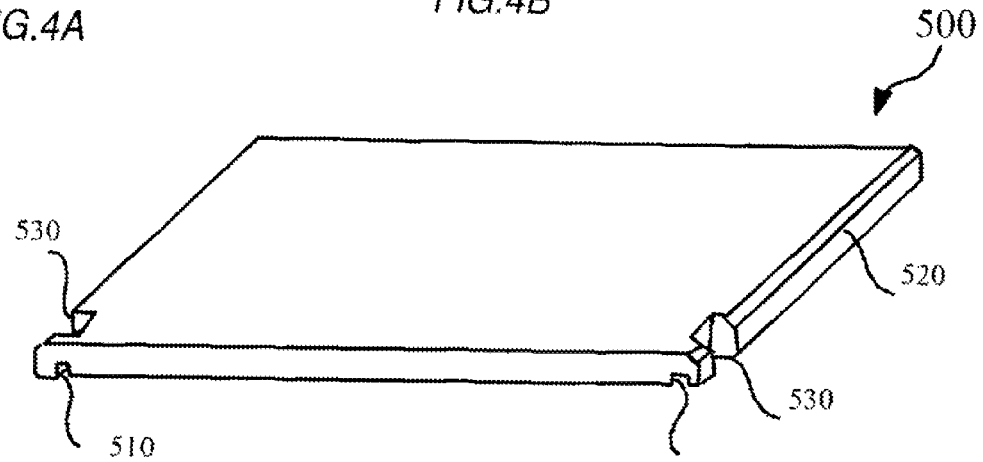
FIG. 5 illustrates a perspective view of an example horizontal surface that may be used above a rod bracket in a modular storage system, according to one embodiment.

FIG. 5 illustrates a perspective view of an example horizontal surface 500 that may be used above a rod bracket 400 in a modular storage system. The horizontal surface 500 may be similar to the horizontal surface 130 and include grooves 510 formed in a lower surface thereof for mounting on the cleats 114. The horizontal surface 500 may also include tapered edges 520. In addition, the horizontal surface 500 may include notches 530 formed in edges thereof to fit around the rod bracket 400.

According to one embodiment, the side panels 110 may include holes formed therein at certain locations to enable a standard rod receptacle to be mounted thereto rather than utilizing the rod bracket 400. The holes may be located below the cleats 114 at locations where the rod bracket 400 would be utilized.

Figure 6:
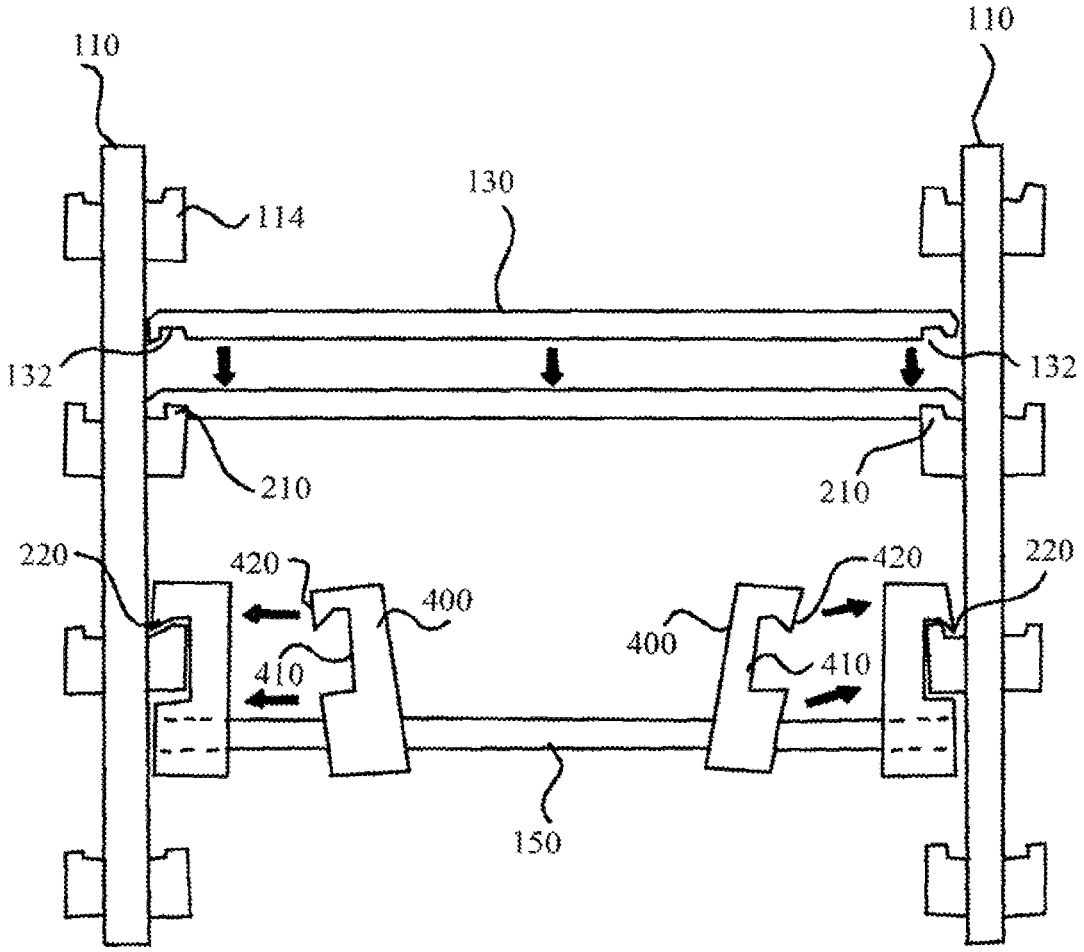
FIG. 6 illustrates a side view of components being placed in a section of an example modular storage system, according to one embodiment.

FIG. 6 illustrates a side view of components being placed in a section of an example modular storage system. The system includes side panels 110 each having a plurality of cleats 114, a horizontal surface 130, rod brackets 400 and a rod 150. The horizontal surface 130 is secured to the appropriate cleats 114 by lowering the horizontal surface 130 onto the cleats 114 such that the channel 132 aligns with and fits over the second portion 210 of the cleat 114. The horizontal surface 130 is self-locking within the system as it does not require any tools or fasteners to install or remove it therefrom. The rod brackets 400 are secured to the cleats 114 by moving the rod brackets 400 laterally such that the channel 410 goes over the cleat 114 and the upper arm 420 fits within the groove 220. The placement of the rod 150 between adjacent rod brackets 400 will secure the rod bracket 400 against the side panels 110 (self-lock the rod brackets 400 within the system).

As discussed above, a system may desire to have horizontal surfaces 130 located at distances less that distance the cleats 114 are apart from one another. For example, the spacing between cleats 114 may be a standard shelf height (e.g., 14 inches). If an individual wants to use the horizontal surfaces 130 as a shoe rack that distance may be excessive. Accordingly, spacers may be utilized to enable a horizontal surface 130 to be located between the cleats 114.

Figure 7:
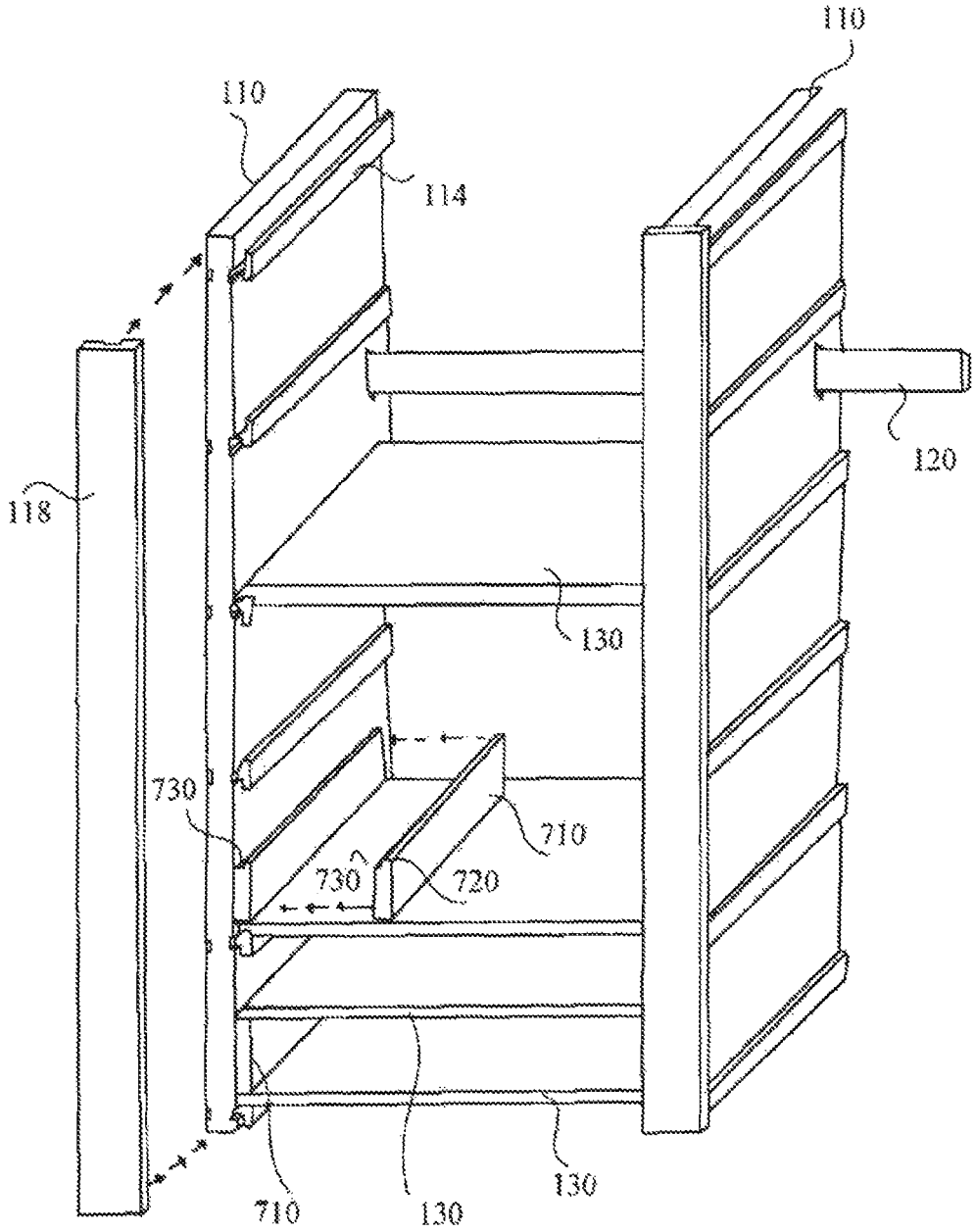
FIG. 7 illustrates a side view of spacers being utilized in a section of an example modular storage system, according to one embodiment.

FIG. 7 illustrates a side view of spacers being utilized in a section of an example modular storage system. The system includes side panels 110 each having a plurality of cleats 114 and a face plate 118 and a plurality of horizontal surfaces 130 mounted between the side panels 110 on associated cleats 114. The face plate 118 is to secure the horizontal surfaces 130 with the system (prevents the horizontal surfaces 130 from being able to be pulled or slide straight out) and to provide an aesthetically pleasing look. As illustrated, the second horizontal surface 130 from the bottom of the system is not associated with any cleats 114. This horizontal surface 130 may be mounted on a spacer 710. A spacer 710 is more easily illustrated being installed above the third horizontal surface 130 from the bottom of the system. The spacer 710 includes a main body having an arm 720 extending upward on an inner edge (edge away from the side panel 110). The spacer 710 is slid against the side panel 110 so as to in effect create another cleat. When slid against the side panel 110 a groove 730 is formed, much like the grove 220 formed between the second portion 210 of the cleat 114 and the side panel 110. When a horizontal surface 130 is installed between the side panels 110 on the spacers 710, the horizontal surface 130 will secure the spacers 710 in place (the spacers 710 are self-locking within the system). Accordingly, tools are not required to install the spacers 710.

As illustrated, the spacer 710 is located on top of a horizontal surface 130. Such a configuration assumes that a horizontal surface 130 is desired on that cleat and between that cleat and the next cleat (e.g., desired distance between horizontal surfaces is half the spacing of the cleats). However, it is possible that a desired spacing between horizontal surfaces 130 is greater than the spacing between consecutive cleats 114 but not as far apart as alternating cleats (e.g., desired distance between horizontal surfaces is one-and-a-half times the spacing of the cleats). In such an embodiment, it is possible to mount the spacers 710 directly on the cleats 114.

The use of the spacers 710 enables horizontal surfaces 130 to be installed in the system at additional locations without the need for fasteners to be mounted to the side panels 110 or for the side panels to include a plurality of holes with which pins may be inserted.

As discussed above, a system may desire to have drawers 140. In order to enable drawers 140 to be utilized, the system must include a glide means (e.g., glide rails). Rather than requiring glide rails to be mounted to the side panels 110, glide rail inserts may be utilized. Glide rail inserts may include glide rails mounted thereon and be able to be placed with the system at the appropriate locations. For example, the glide rail inserts may be placed on a horizontal surface 130 along the side panels 110.

Figure 8:
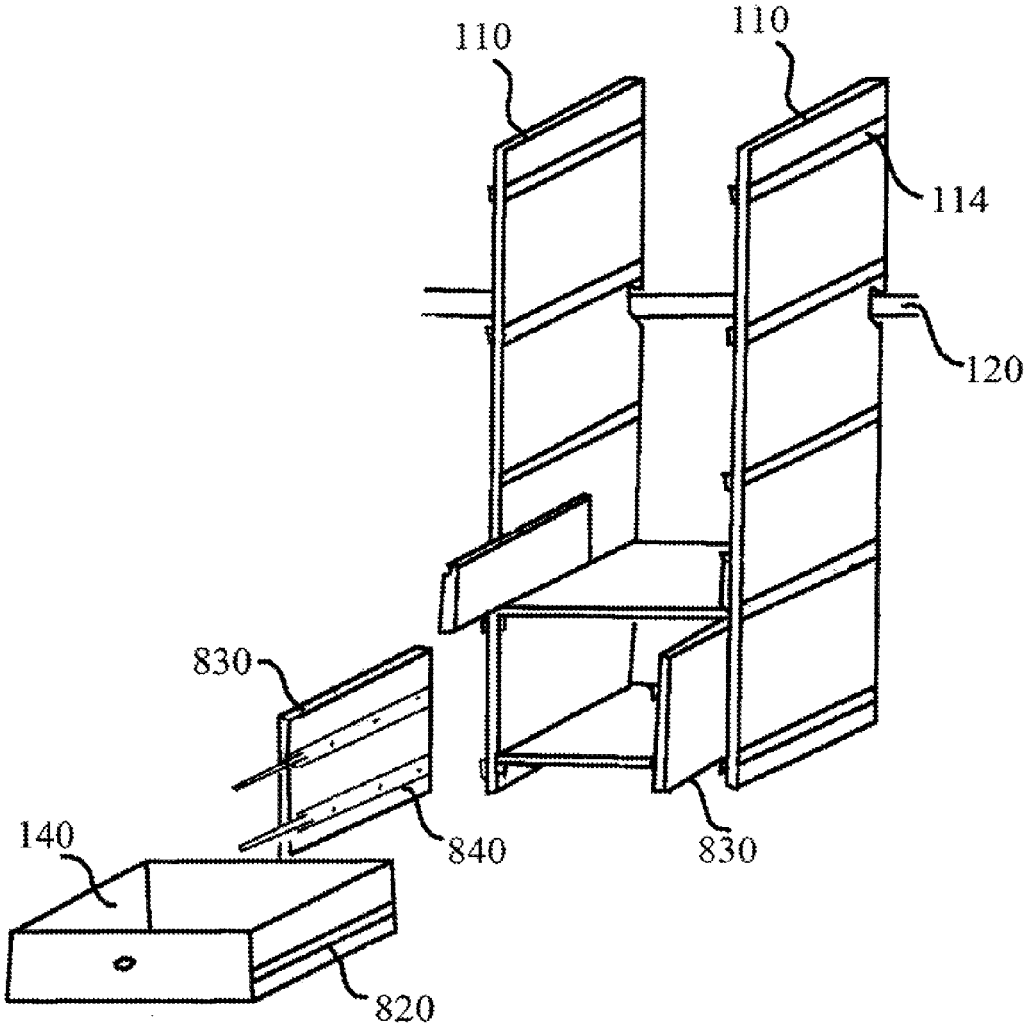
FIG. 8 illustrates a side view of glide rail inserts being utilized in a section of an example modular storage system, according to one embodiment.

FIG. 8 illustrates a side view of glide rail inserts being utilized in a section of an example modular storage system. The system includes side panels 110 each having a plurality of cleats 114, horizontal surfaces 130 mounted between the side panels 110 on associated cleats 114, and drawers 140. The drawers 140 include glide rails 820 on the exterior siders thereof. Glide rail inserts 830 that include glide rails 840 mounted on an interior side (side facing away from side panels 110) are utilized in the system to receive the drawers 140. The glide rail inserts 830 are placed on a horizontal surface 130 against the side panel 110 to provide glide rails 840 on the side panels 110. When the drawers 140 are inserted such that the glide rails 820 and the glide rails 840 engage one another, the drawer 140 will secure the glide rail inserts 830 in place. The glide rail inserts 830 are self-locking within the system as they do not require any tools or fasteners to install or remove them therefrom.

It should be noted that FIG. 8 does not include a face plate 118 for ease of illustration. However, the system may include a face plate 118 to secure the horizontal surfaces 130 with the system by preventing the horizontal surfaces 130 from being able to be pulled or slide straight out. Furthermore, the face plate 118 may provide an aesthetically pleasing look.

According to one embodiment, the system may include optional storage fixtures including, but not limited to, laundry baskets, garment racks and trash cans. The optional storage fixtures may operate like a drawer and be pulled out when access thereto is desired and pushed in when not in use. Operating the optional storage fixtures like a drawer allows the optional storage fixtures to be hidden from view and/or be within the system when not in use. The laundry baskets and trash cans, or items hanging on the garment racks, may extend below an access point thereto.

Figure 9:
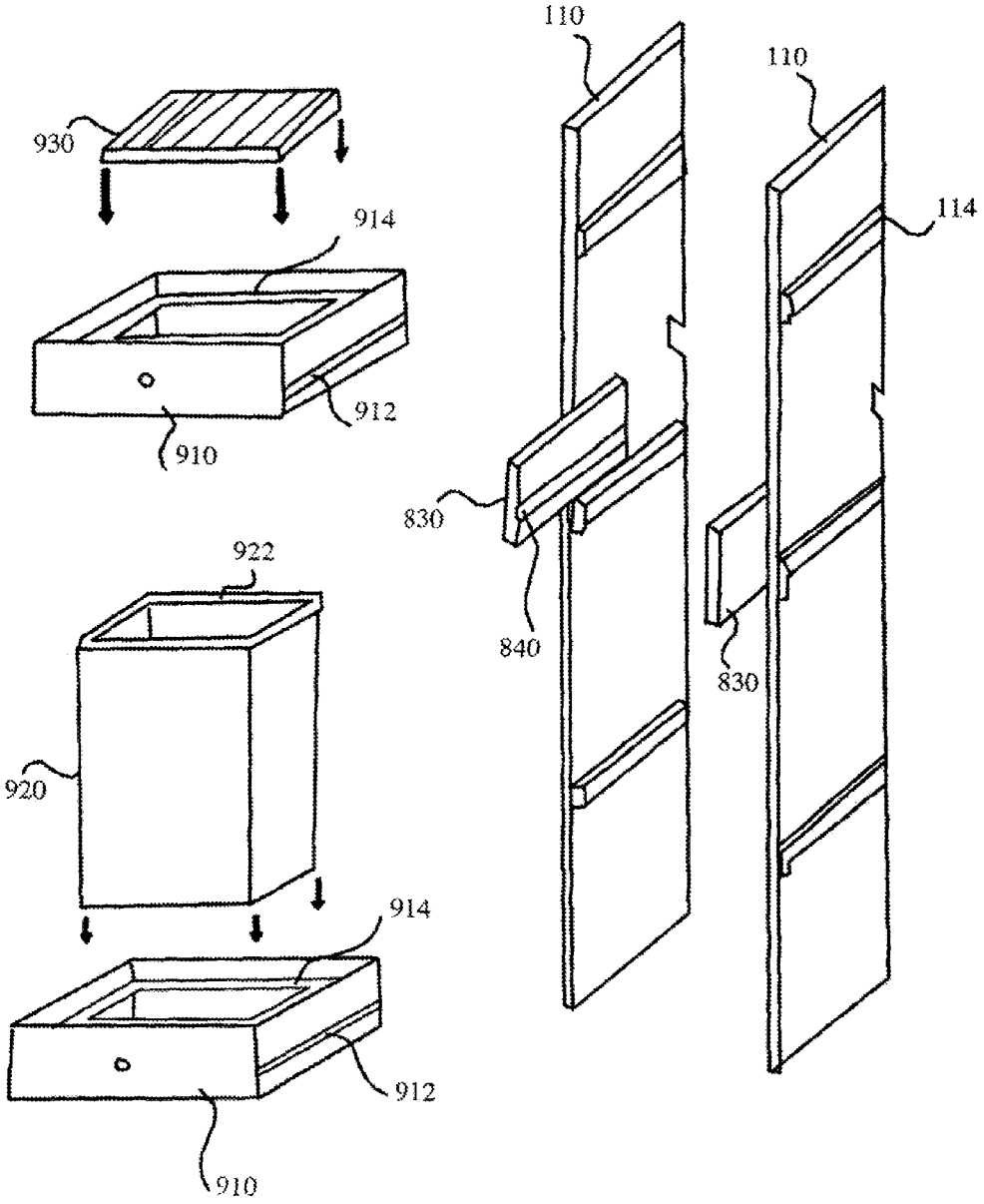
FIG. 9 illustrates an exploded view of a section of an example modular storage system that includes optional storage fixtures, according to one embodiment.

FIG. 9 illustrates an exploded view of a section of an example modular storage system that includes optional storage fixtures (e.g., laundry basket, garment rack, trash can). The system includes side panels 110 each having a plurality of cleats 114 and horizontal surfaces 130 (not illustrated but understood to be required to provide lateral support) mounted between the side panels 110 on associated cleats 114. The system utilizes an accessory glide box 910 that is configured to accept many optional storage fixtures including, for example, a clothes hamper or trash can 920 and a hanging garment rack 930. The accessory glide box 910 is similar to a drawer 810 except that it does not include a bottom. The accessory glide box 910 includes glide rails 912 on the exterior sides thereof and a lip 914 formed around an interior perimeter for holding the optional storage fixtures (e.g., clothes hamper/trash can 920, hanging garment rack 930).

The clothes hamper or trash can 920 may include a lip 922 that extends from an outer perimeter of the upper surface. The clothes hamper or trash can 920 may be inserted through the accessory glide box 910 until the lip 922 comes to rest on the lip 914. Likewise, an outer perimeter of the hanging garment rack 930 may have dimensions such that it comes to rest on the lip 914.

The system may utilize the glide rail inserts 830 that include glide rails 840 to receive the accessory glide box 910 and the optional storage fixtures (e.g., clothes hamper/trash can 920, hanging garment rack 930). Since the laundry baskets/trash cans 920 and items hanging on the garment racks 930 may extend below the accessory glide box 910 a horizontal surface 130 may not be utilized to support the glide rail inserts 830 (the glide rail inserts 830 may not rest on a horizontal surface 130). Accordingly, the glide rail inserts 830 may be placed directly on the cleats 114 and against the side panel 110 to provide glide rails 840 on the side panels 110. When the accessory glide box 910 is inserted such that the glide rails 912 and the glide rails 840 engage one another, the accessory glide box 910 will secure the glide rail inserts 830 in place (the glide rail inserts 830 are self-locking within the system).

It should be noted that FIG. 9 does not include a face plate 118 for the side panels 110 for ease of illustration.

Figure 10:
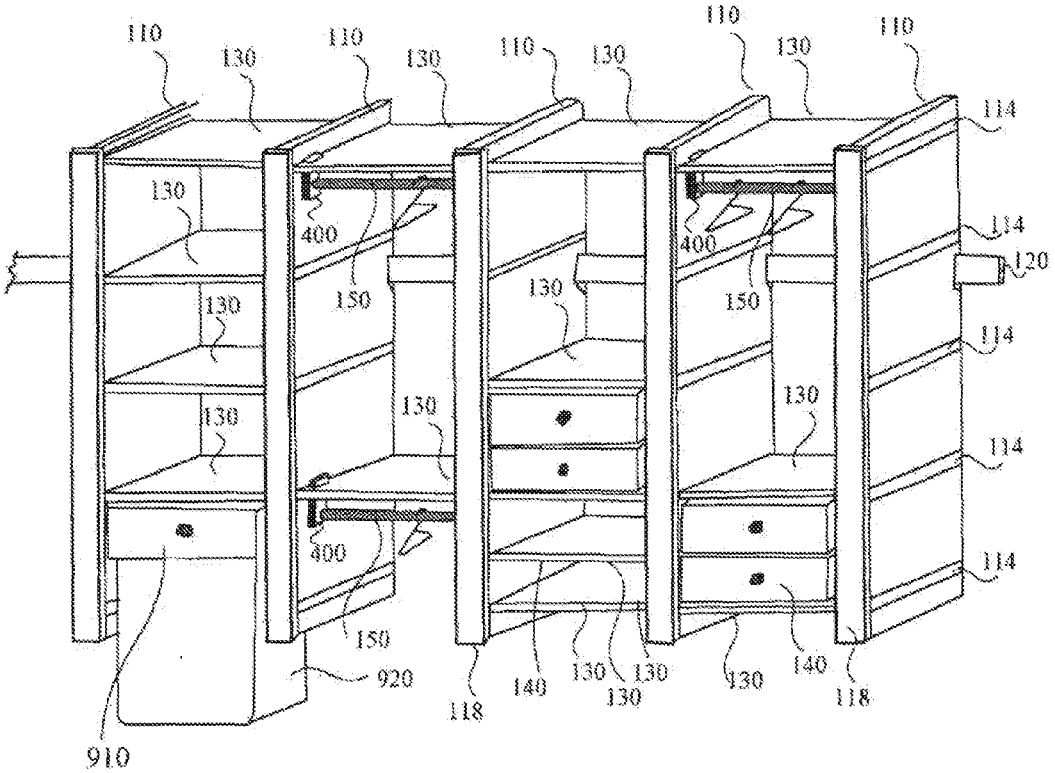
FIG. 10 illustrates a perspective view of an example modular storage system including various different components, according to one embodiment.

FIG. 10 illustrates a perspective view of an example modular storage system including various different components. As illustrated, the system includes five side panels 110 secured to a support rail 120 to create four storage sections. As illustrated, each side panel 110 includes a face plate 118 and five cleats 114 on each side thereof that are all in alignment with each other (for ease of illustration the cleats 114 are only labeled on the far right side panel 110). It should be noted that the side panels 110 are in no way intended to be limited to having five cleats 114. A horizontal surface 130 is mounted on the top cleats 114 of each storage section. These horizontal surfaces 130 provide lateral support for the side panels 110 as well as providing storage on the top of the system.

A first storage section on the left includes horizontal surfaces 130 on the first four sets of cleats 114. Below the fourth horizontal surface 130 is an accessory glide box 910 housing a laundry baskets/trash cans 920. While not illustrated, glide rail inserts 830 would be utilized to enable the accessory glide box 910 to slide in and out of the system. As illustrated, the accessory glide box 910 only covers a portion of the laundry basket/trash can 920 but is not limited hereto. Rather, the accessory glide box 910 could include a face plate that covered a larger portion of the laundry basket/trash can 920 without departing from the scope of the invention. A second storage section from the left includes horizontal surfaces 130 on the first and fourth sets of cleats 114. Below both horizontal surfaces 130 are rods 150 secured using rod brackets 400.

A third storage section from the left includes horizontal surfaces 130 on the first and third through fifth sets of cleats 114. In addition there is a horizontal surface 130 between the fourth and fifth sets of cleats 114 which would require a spacer 710 (not illustrated). Between the third and fourth sets of cleats 114 are a double drawer or pair of drawers 140. While not illustrated glide rail inserts 830 would be utilized to enable the drawer(s) 140 to slide in and out of the system. A fourth storage section from the left includes horizontal surfaces 130 on the first, fourth and fifth sets of cleats 114. Below the first horizontal surface 130 is a rod 150 secured using rod brackets 400. Between the fourth and fifth sets of cleats 114 are a double drawer or pair of drawers 140 which would require glide rail inserts 830 (not illustrated).

The modular storage systems described above provide self-locking of various components therewithin. This enables the components to be installed, removed and/or rearranged with ease (no tools or fasteners required). The use of notch 112 on the side panels 110 enables the side panels 110 to be easily arranged and rearranged on the support rail 120. The use of the horizontal surfaces 130 to provide lateral support enables the side panels 110 to be secured to the wall without the need for additional fasteners. The use of cleats 114 and corresponding channels 132 provides self-locking of the horizontal surfaces 130 and enables a user to easily arrange and rearrange the location of the horizontal surfaces 130 and customize their placement in a system easily and without the use of tools or mounting hardware. The use of self-locking spacers 710 that in effect create additional cleats provides further customizing for the location of the horizontal surfaces 130. The use of self-locking glide rail inserts 830 enable drawers 140 and/or accessory glide boxes 910 and associated optional storage fixtures to easily be arranged and rearranged and customize their placement in a system easily without the use of tools or mounting hardware.

The systems descried herein are capable of receiving and mounting a plurality of fixtures without the need for sidewall support. For example, in many traditional modular closet designs, components of the system must be mounted to the side wall of the closet or room. In the present invention, the use of a horizontal support rail 120 is preferably mounted to a single rear wall with the vertical hanging side panels 110 mounted thereto and able to be configured to any number of locations along the support rail 120. In this manner, the system is configured to receive a plurality of fixtures and provide lateral support without the need for sidewall mounting.

While the systems described above are hung on the horizontal support rail 120, the systems are not limited thereby. Rather, the systems could be designed to be stand-alone systems that are not connected to the wall in any fashion. For example, the system could include some type of feet for resting on the floor. The use of the self-locking components would provide the support for the stand-alone system.

In preferred embodiments, the various components of a modular storage system are made from wood or wood laminate. In other embodiments, the modular storage device may be made from wood, wood laminate, plastic, canvas, metal, or any other combination of materials common in the art of storage fixtures and furniture.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A modular storage system comprising:

a plurality of vertical side panels, wherein each vertical side panel includes:

a plurality of generally L-shaped cleats mounted to each side, wherein the plurality of cleats on each side are spaced a defined distance apart from one another; and a face plate vertically mounted to a front edge, wherein the face plate extends horizontally past the sides so as to hide the plurality of cleats;

a shelf for each adjacent pair of opposing side panels, wherein each shelf includes a channel formed on opposite edges of an underside thereof that corresponds with the cleats, wherein each shelf is to be mounted between the adjacent pair of opposing side panels by mating corresponding cleats within corresponding channels of each shelf to self-lock each shelf within the system, wherein each shelf provides lateral support for the adjacent pair of opposing side panels, wherein the face plates of the adjacent pair of opposing side panels lock each shelf longitudinally between a wall the system abuts and the face plates and prevent each shelf from sliding off the corresponding cleats or exiting the system, and wherein each shelf can be mounted, removed and remounted to any number of locations between any adjacent pair of opposing side panels within the system without tools and/or fasteners; and a pair of spacers to provide an additional location for a shelf to be mounted between any adjacent pair of opposing side panels, wherein each of the pair of spacers has a height that is less than the defined distance between adjacent cleats on a side panel, and a cleat formed in an upper edge thereof, wherein the spacers are to be placed in the system against an adjacent pair of opposing side panels between adjacent cleats so as to extend horizontally, wherein the face plates of the adjacent pair of opposing side panels lock the spacers longitudinally between the wall and the face plates and prevent the spacers from exiting the system, wherein the shelf is mounted by mating the cleats formed in the upper edge of the spacers within corresponding channels of the shelf to self-lock the shelf and secure the pair of spacers against the adjacent pair of opposing side panels, and wherein the spacers can be installed, removed and reinstalled to any number of locations between any adjacent pair of opposing side panels within the system without tools and/or fasteners.

2. The system of claim 1, further comprising at least one desk mounted between an adjacent pair of opposing side panels without tools and/or fasteners.

3. The system of claim 1, wherein the spacers are placed on a shelf.

4. The system of claim 1, wherein the spacers are placed on a pair of aligned cleats from an adjacent pair of opposing side panels.

5. A modular storage system comprising:

a plurality of vertical side panels, wherein each vertical side panel includes a plurality of cleats running horizontally;

at least one horizontal surface for each adjacent pair of opposing side panels, wherein each horizontal surface includes a channel formed on opposite edges of an underside thereof in alignment with a cleat, wherein each horizontal surface is to be mounted between the adjacent pair of opposing side panels by securing the corresponding channels and cleats to self-lock the horizontal surface within the system, wherein each horizontal surface provides lateral support for the adjacent pair of opposing side panels, wherein each horizontal surface can be mounted, removed and remounted to any number of locations between any adjacent pair of opposing side panels within the system without tools and/or fasteners, and wherein each horizontal surface is adapted to store or support an object;

a pair of glide rail inserts to receive a slideable storage device, wherein each glide rail insert includes at least one glide rail located on an inner surface, wherein the pair of glide rail inserts are to be placed in the system against an adjacent pair of opposing side panels; and a storage device having a glide rail located on an exterior surface, wherein the pair of glide rail inserts are locked into place against the adjacent pair of opposing side panels when the storage device is installed between the pair of glide rail inserts within the storage system, and wherein the glide rail inserts can be installed, removed and reinstalled to any number of locations between any adjacent pair of opposing side panels within the system without tools and/or fasteners.

6. The system of claim 5, wherein the storage device is a drawer.

7. The system of claim 5, wherein the pair of glide rail inserts are placed on a horizontal surface.

8. The system of claim 5, wherein the storage device includes an accessory glide box housing a storage fixture therewithin.

9. The system of claim 5, wherein the pair of glide rail inserts are placed on a pair of aligned cleats from the adjacent pair of opposing side panels.

10. The system of claim 8, wherein the storage fixture is a hamper.

11. The system of claim 8, wherein the storage fixture is a trash can.

12. The system of claim 8, wherein the storage fixture is a garment rack.

13. A modular storage system having self-locking components that do not require tools or fasteners to configure, the system comprising:

a plurality of side panels, wherein each side panel includes:

a front edge, a back edge, a top edge, a bottom edge, and two opposed sides, a plurality of cleats horizontally mounted to each side, wherein the plurality of cleats on each side are spaced a defined distance apart from one another, wherein each of the plurality of cleats includes a first portion that is directly connected to the side and extends away from the side and a second portion that extends upward from the first portion, and a face plate vertically mounted to the front edge, wherein the face plate extends horizontally past the sides so as to hide the plurality of cleats; and a plurality of horizontal surfaces, wherein at least one horizontal surface is located between each adjacent pair of opposing side panels, wherein each horizontal surface includes a channel formed on opposite edges of an underside thereof, wherein each channel is notched out from the underside so as to include two sidewalls and is configured to receive the second portion of the cleats, wherein each horizontal surface is to be mounted between an adjacent pair of opposing side panels by mating the second portion of a corresponding pair of aligned cleats within corresponding channels of each horizontal surface in order to self-lock the horizontal surface within the system, wherein the face plates of the adjacent pair of opposing side panels lock each horizontal surface longitudinally between a wall the system abuts and the face plates and prevent each horizontal surface from sliding off the corresponding cleats or exiting the system, wherein at least one horizontal surface is installed between each adjacent pair of opposing side panels to provide lateral support for each adjacent pair of opposing side panels, wherein each horizontal surface is adapted to store or support an object, and wherein each horizontal surface can be mounted, removed and remounted to any number of locations between any adjacent pair of opposing side panels within the system without tools and/or fasteners.

14. The system of claim 13, further comprising a pair of rod brackets, wherein each of the pair of rod brackets has a channel formed in a first side thereof and a receptacle having an opening formed in a second side thereof that is opposite to the first side, wherein each of the rod brackets is mounted to a respective one of an adjacent pair of opposing side panels by engaging the channel and a corresponding cleat of an aligned pair of cleats; and a rod to be inserted into the receptacle of adjacent rod brackets, wherein the rod secures the rod brackets against the adjacent pair of opposing side panels to self-lock the rod brackets within the system.

15. The system of claim 13, further comprising a pair of spacers to provide an additional location for an additional horizontal surface to be mounted between an adjacent pair of opposing side panels, wherein each of the pair of spacers has a height that is less than the defined distance between adjacent cleats on a side panel, and a cleat formed in an upper edge thereof, wherein the spacers are to be placed in the system against an adjacent pair of opposing side panels between adjacent cleats so as to extend horizontally, wherein the face plates of the adjacent pair of opposing side panels lock the spacers longitudinally between the wall and the face plates and prevent the spacers from exiting the system, wherein the additional horizontal surface is mounted by mating the cleats formed in the upper edge of the spacers with corresponding channels formed in the underside of the additional horizontal surface in order to self-lock the additional horizontal surface and secure the pair of spacers against the adjacent pair of opposing side panels, and wherein the spacers can be installed, removed and reinstalled to any number of locations between any adjacent pair of opposing side panels within the system without tools and/or fasteners.

16. The system of claim 13, further comprising a pair of glide rail inserts to receive a slideable storage device, wherein each glide rail insert includes at least one glide rail mounted thereto, wherein a first glide rail insert of the pair of glide rail inserts is to be placed in the system against a first side panel of an adjacent pair of opposing side panels so that the glide rail faces inward and a second glide rail insert of the pair of glide rail inserts is to be placed against a second side panel of the adjacent pair of opposing side panels so that the glide rail faces inward; and at least one storage device having a glide rail located on an exterior surface, wherein the pair of glide rail inserts are locked into place against the adjacent pair of opposing side walls when the at least one storage device is installed within the system and engages with the pair of glide rail inserts, and wherein the glide rail inserts can be installed, removed and reinstalled to any number of locations between any adjacent pair of opposing side panels within the system without tools and/or fasteners.

17. The system of claim 13, wherein the horizontal surface includes a shelf or a desk.

18. The system of claim 15, wherein the pair of spacers are placed on a horizontal surface or a pair of aligned cleats from an adjacent pair of opposing side panels.

19. The system of claim 16, wherein the pair of glide rail inserts are placed on a horizontal surface or a pair of aligned cleats from an adjacent pair of opposing side panels.

20. The system of claim 16, wherein the storage device includes a drawer or an accessory glide box housing a storage fixture therewithin, wherein the storage fixture includes a hamper, a trash can or a garment rack.

* * * * *